US009408287B2

(12) United States Patent
Opaits et al.

(10) Patent No.: US 9,408,287 B2
(45) Date of Patent: Aug. 2, 2016

(54) SYSTEM AND METHOD FOR CONTROLLING PLASMA INDUCED FLOW

(71) Applicant: General Electric Company, Schenectady, NY (US)

(72) Inventors: Dmytro Floriyovych Opaits, Glenville, NY (US); Seyed Gholamali Saddoughi, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 428 days.

(21) Appl. No.: 13/686,098

(22) Filed: Nov. 27, 2012

(65) Prior Publication Data

US 2014/0147290 A1 May 29, 2014

(51) Int. Cl.
*H05H 1/24* (2006.01)
*F15C 1/04* (2006.01)

(52) U.S. Cl.
CPC ..... *H05H 1/2406* (2013.01); *H05H 2001/2412* (2013.01)

(58) Field of Classification Search
CPC ..... H05H 1/34; H05H 1/54; H05H 1/24; H05H 1/48; H05H 1/26; H05H 2001/3436; H05H 2001/3442; H05H 2001/2462; H05H 2001/2468; H05H 2001/3431; H05H 1/2406; H05H 1/2412; H05H 2001/2412; F15C 1/04; F04B 19/00
USPC ..... 315/111.01–111.91; 219/121.36–121.55
See application file for complete search history.

(56) References Cited

U.S. PATENT DOCUMENTS

| | | | | |
|---|---|---|---|---|
| 4,639,642 | A * | 1/1987 | Roberts et al. | 315/39 |
| 5,637,961 | A | 6/1997 | Ishii et al. | |
| 5,961,772 | A * | 10/1999 | Selwyn | 156/345.39 |
| 6,421,421 | B1 * | 7/2002 | McGeoch | 378/119 |
| 6,764,658 | B2 | 7/2004 | Denes et al. | |
| 7,380,756 | B1 | 6/2008 | Enloe et al. | |
| 7,829,815 | B2 | 11/2010 | Chen et al. | |
| 7,892,611 | B2 | 2/2011 | Swallow et al. | |
| 2002/0186815 | A1 * | 12/2002 | McGeoch | 378/119 |
| 2008/0302514 | A1 | 12/2008 | Ouyang | |
| 2009/0169367 | A1 * | 7/2009 | Wadia et al. | 415/151 |
| 2009/0200948 | A1 * | 8/2009 | Selwyn | 315/111.21 |
| 2010/0284786 | A1 | 11/2010 | Wadia et al. | |
| 2011/0101862 | A1 * | 5/2011 | Koo et al. | 315/111.21 |

(Continued)

OTHER PUBLICATIONS

A R Hoskinson and N Hershkowitz; "Differences Between Dielectric Barrier Discharge Plasma Actuators with Cylindrical and Rectangular Exposed Electrodes"; Journal of Physics D: Applied Physics, 43 (2010) 065205 (8pp); 9 Pages.

(Continued)

*Primary Examiner* — Jimmy Vu
(74) *Attorney, Agent, or Firm* — Ann M. Agosti

(57) ABSTRACT

A plasma actuator system includes a first electrode having a first slit formed in a first peripheral section of the first electrode. The first slit directs flow of a gaseous medium along a radial direction of the first electrode. Further, the plasma actuator system includes a second electrode coupled to the first electrode and is disposed concentrically around the first electrode. The second electrode includes a second slit formed in a second peripheral section for directing flow of the gaseous medium along the radial direction. Further, the system includes a power source coupled to the first and second electrode for supplying electric power to the electrodes for ionizing gaseous medium to generate plasma.

13 Claims, 8 Drawing Sheets

(56) References Cited

U.S. PATENT DOCUMENTS

| | | | | |
|---|---|---|---|---|
| 2012/0062887 | A1* | 3/2012 | Kim et al. | 356/316 |
| 2013/0127969 | A1* | 5/2013 | De Schamphelaere et al. | 347/125 |

OTHER PUBLICATIONS

A R Hoskinson and N Hershkowitz; "Modelling of Dielectric Barrier Discharge Plasma Actuators with Thick Electrodes"; Journal of Physics D: Applied Physics, 44 (2011) 085202 (11pp); 12 Pages.

* cited by examiner

SYSTEM AND METHOD FOR CONTROLLING PLASMA INDUCED FLOW

BACKGROUND

The disclosure relates generally to Electro-hydrodynamic (EHD) devices and more particularly, to a system and method for controlling plasma induced flow in an EHD device, for example plasma actuators.

An Electro-hydrodynamic (herein also referred as "EHD") device is used to ionize a gaseous medium to generate plasma. Typically, a charged ion (herein also referred as "a charged particle") is separated from the plasma to transfer momentum to a neutral gaseous medium. The neutral gaseous medium is then ejected out of the EHD device. In general, the performance of the EHD devices, such as ion wind, and Dielectric Barrier Discharge (herein also referred as "DBD") plasma actuator, is dependent on a flow velocity of the neutral gaseous medium, generated by such devices. The typical DBD plasma actuator is one-dimensional shape or has planar configuration having two large parallel plates. Such DBD plasma actuators may produce the flow velocity not exceeding 8 m/s. One reason for DBD plasma actuators not generating a velocity greater than 8 m/s is due to space charge limitation.

The space charge limitation is based on availability of the charged particles and an electric field applied for producing the charged particles. The electric field and amount of the charged ions are implicitly limited by the gaseous medium breakdown electric field value. In the conventional plasma actuators, the charged particles between one or more flat electrode may distort the applied electric field, and do not let more new charged particles to enter the plasma, thus limiting the electric current.

Thus, there is a need for an improved plasma actuator for efficiently reducing the space charge limitation.

BRIEF DESCRIPTION

In accordance with one exemplary embodiment, a plasma actuator system is disclosed. The plasma actuator system includes a first electrode having a first slit formed in a first peripheral section of the first electrode. The first slit is configured for directing flow of a gaseous medium along a radial direction of the first electrode. Further, the plasma actuator system includes a second electrode which is coupled to the first electrode and disposed concentrically around the first electrode. Further, the second electrode has a second slit in a second peripheral section of the second electrode. The second slit is configured for directing flow of the gaseous medium along the radial direction of the second electrode. Further, the plasma actuator system includes a power source coupled to the first electrode and the second electrode for supplying electric power to the first electrode and the second electrode.

In accordance with another exemplary embodiment, a method is disclosed. The method includes supplying electric power to a first electrode and a second electrode. The second electrode is coupled to the first electrode and is disposed concentrically around the first electrode. Further, the method includes receiving a gaseous medium into the first electrode and directing the gaseous medium along a radial direction via a first slit of the first electrode. The method includes ionizing the gaseous medium between the first electrode and the second electrode, to generate plasma. Further, the method includes directing the gaseous medium along the radial direction via a second slit of the second electrode, by imparting momentum to the gaseous medium using the generated plasma.

In accordance with yet another embodiment, an apparatus is disclosed. The apparatus includes an airfoil device, and a plasma actuator system coupled to the airfoil device. Further, the plasma actuator system includes a first electrode having a first slit formed in a first peripheral section of the first electrode. The first slit is configured for directing flow of a gaseous medium along a radial direction of the first electrode. Further, the plasma actuator system includes a second electrode which is coupled to the first electrode and disposed concentrically around the first electrode. Further, the second electrode has a second slit in a second peripheral section of the second electrode. The second slit is configured for directing flow of the gaseous medium along the radial direction of the second electrode. Further, the plasma actuator system includes a power source coupled to the first electrode and the second electrode for supplying electric power to the first electrode and the second electrode.

DRAWINGS

These and other features, aspects, and advantages of the present invention will become better understood when the following detailed description is read with reference to the accompanying drawings in which like characters represent like parts throughout the drawings, wherein.

Figure 3A:
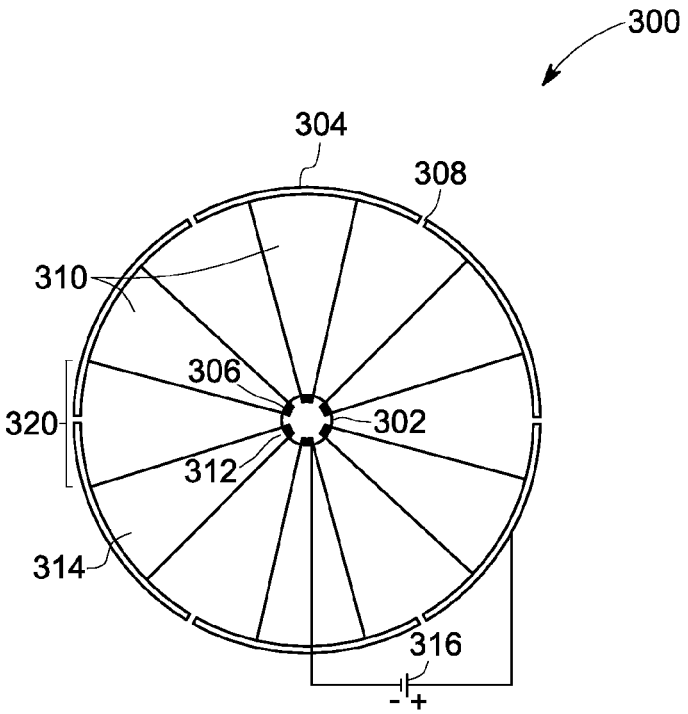
Figure 3B:
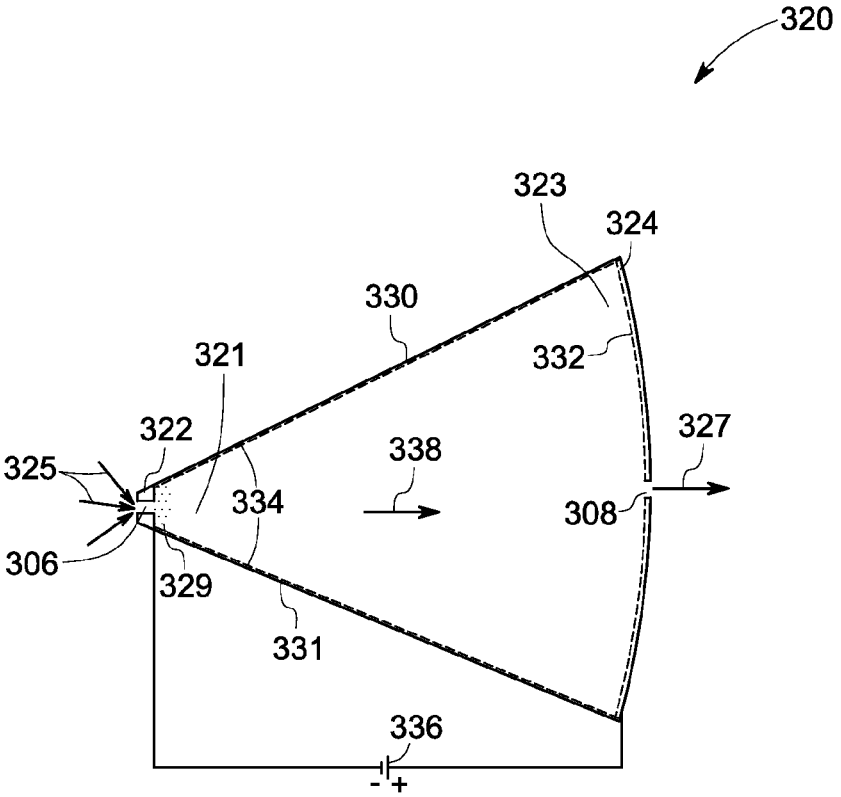
Figure 3C:
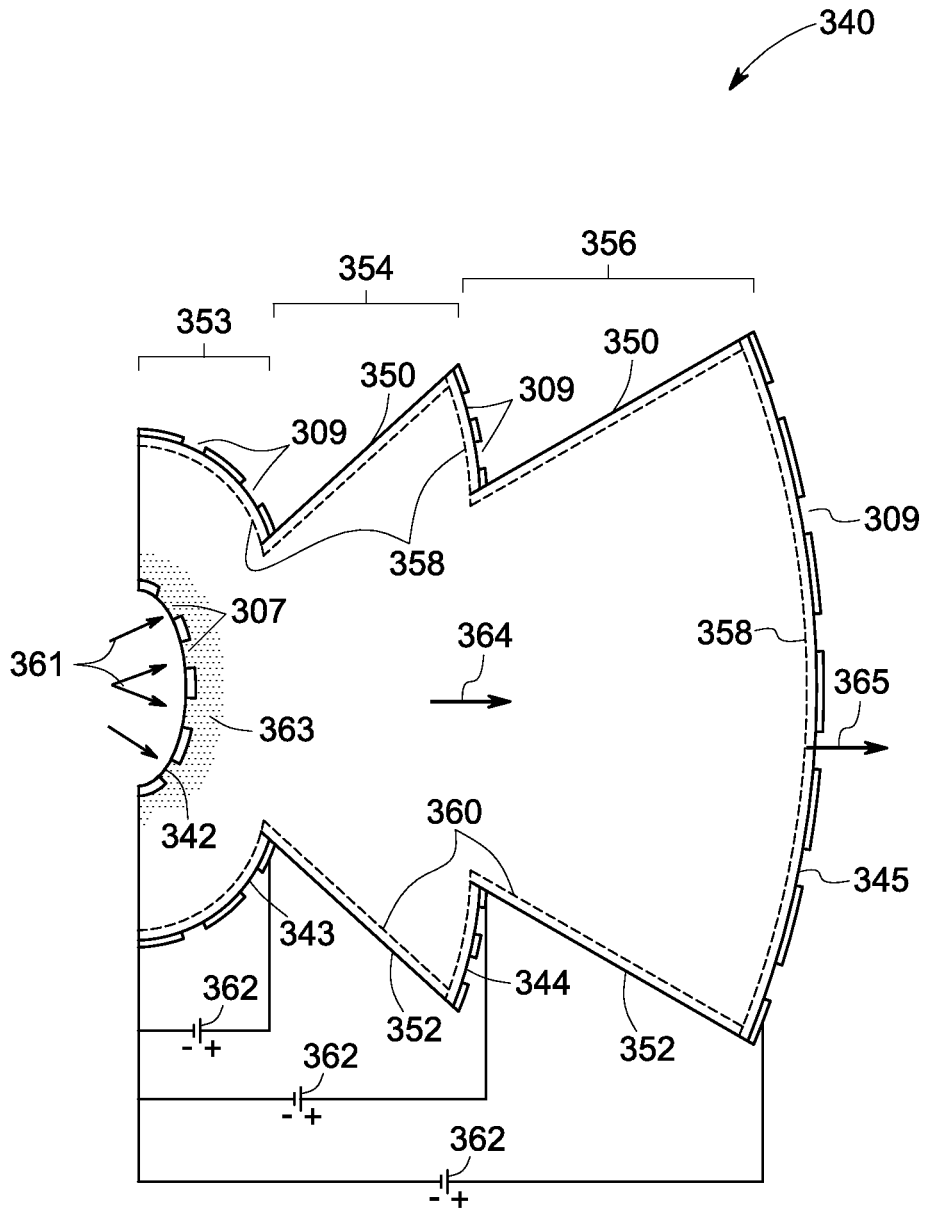
Figure 4:
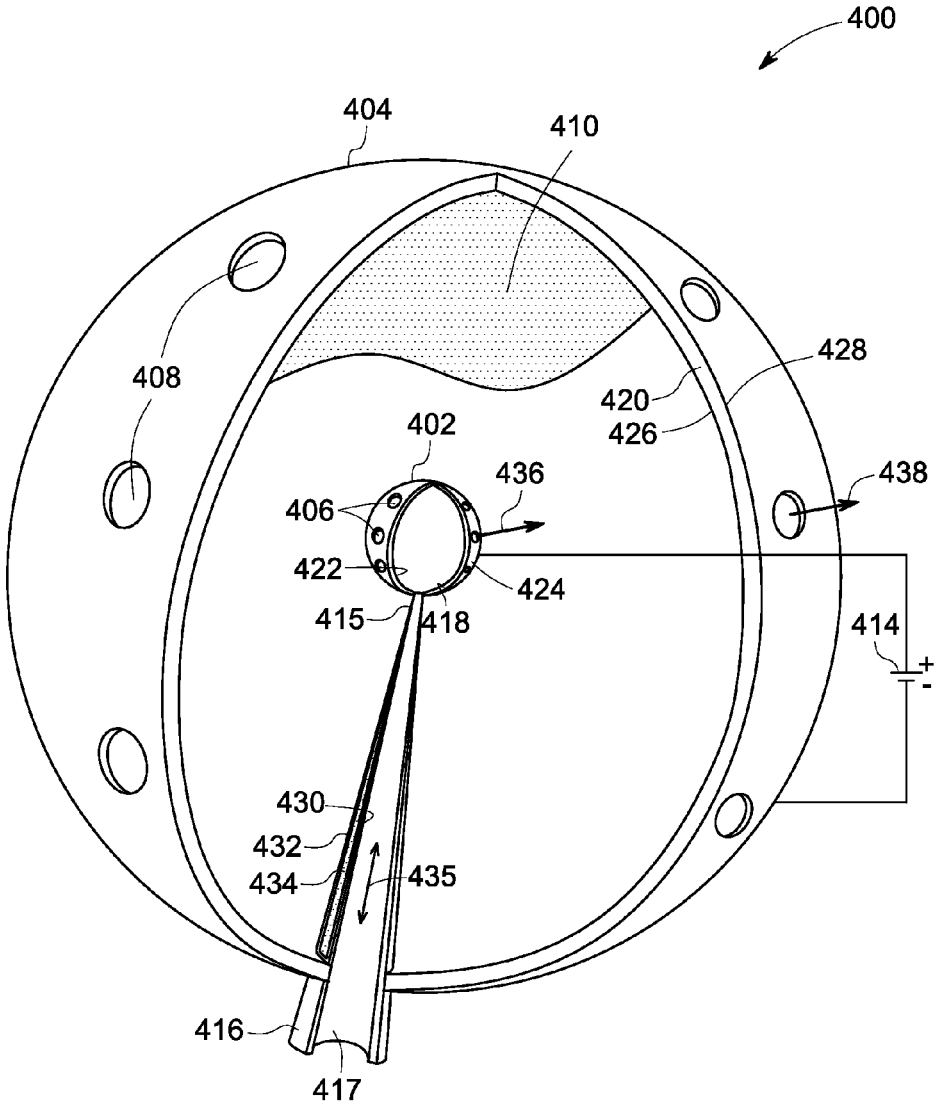
Figure 5A:
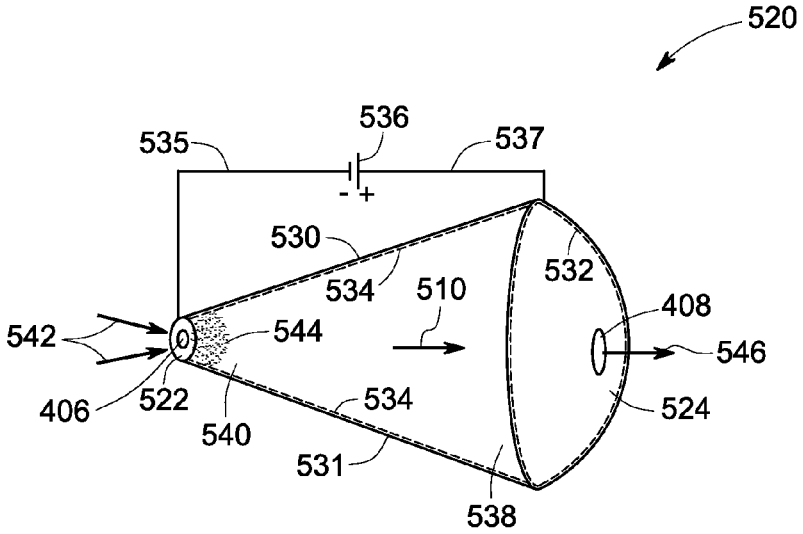
Figure 5B:
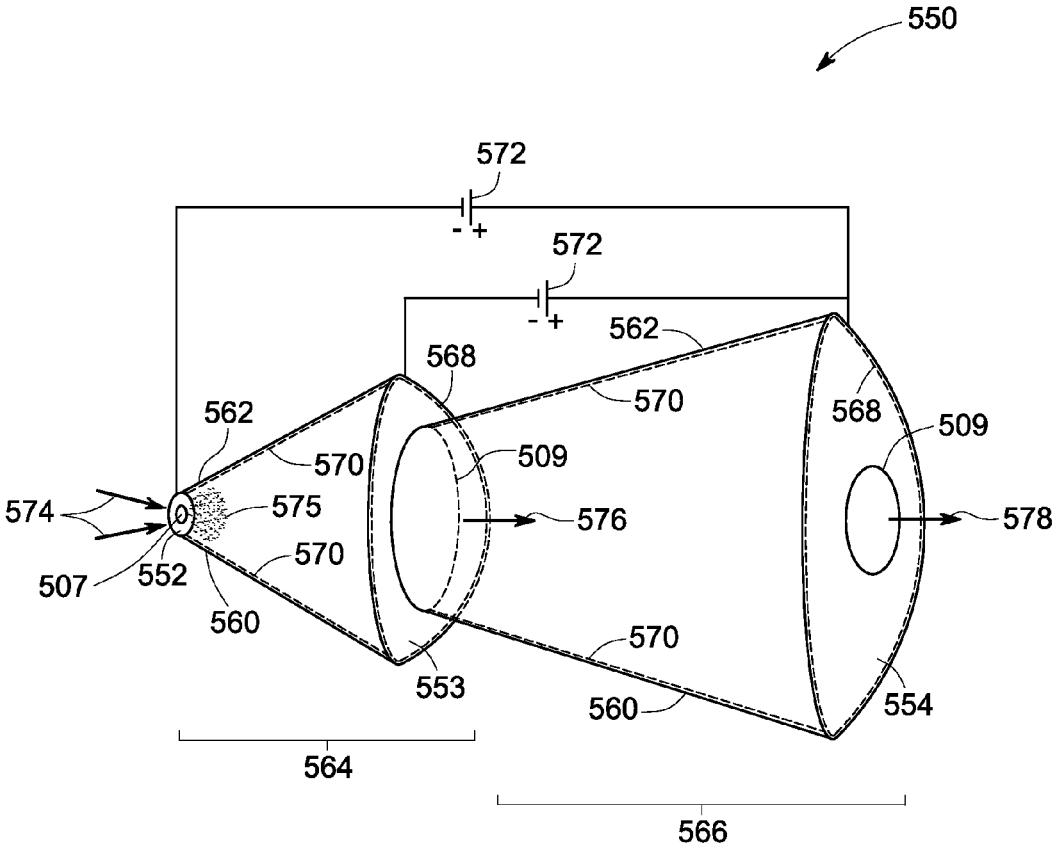
Figure 6:
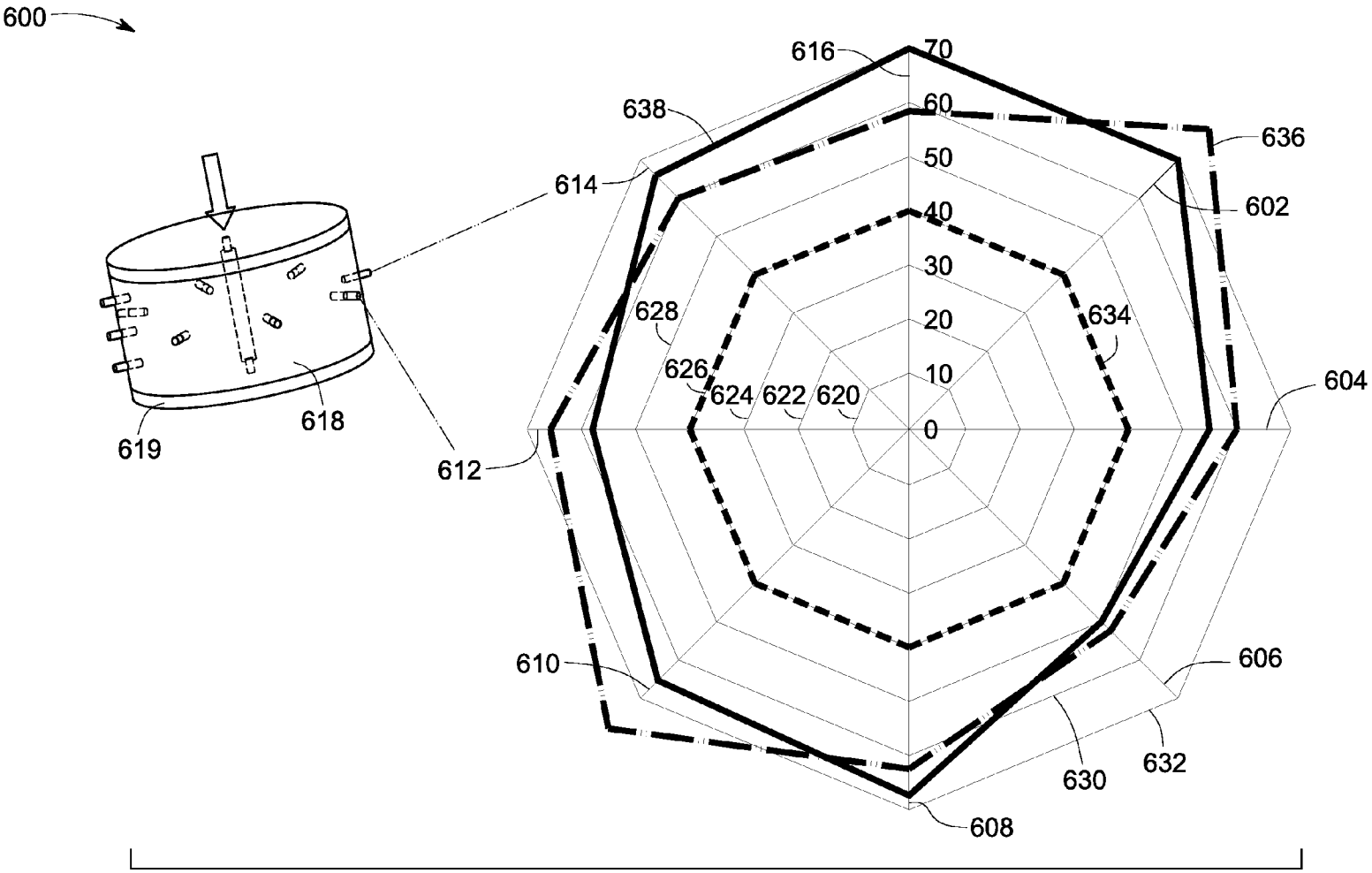
Figure 7:
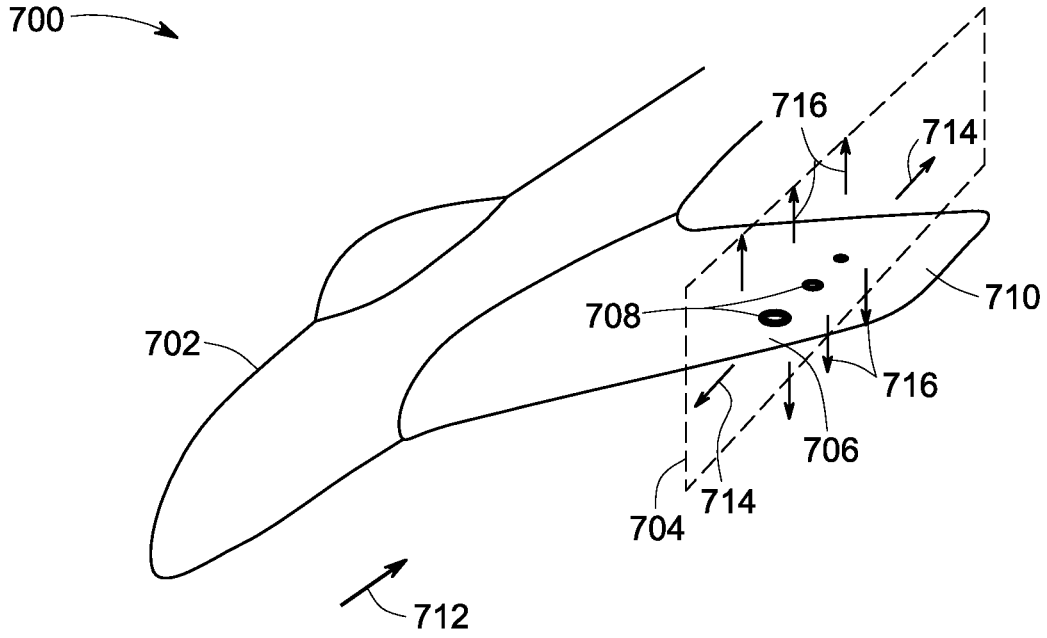

FIG. 3*a* illustrates a cylindrical shaped plasma actuator system having a plurality of sectors in accordance with one exemplary embodiment;

FIG. 3*b* is a sector of a cylindrical shaped plasma actuator system in accordance with an embodiment;

FIG. 3*c* is a multi-sector of a cylindrical shaped plasma actuator system in accordance with an exemplary embodiment;

FIG. 4 illustrates an isometric view of a spherical shaped plasma actuator system in accordance with another exemplary embodiment;

FIG. 5*a* is a sector of the spherical shaped plasma actuator system in accordance with an exemplary embodiment;

FIG. 5*b* is a multi-sector of a spherical shaped plasma actuator system in accordance with an exemplary embodiment;

FIG. 6 is a radar chart representing a circumferential distribution of plasma induced pressure in a plasma actuator, in accordance with one exemplary embodiment; and FIG. 7 illustrates an aircraft having an airfoil with a plasma actuator system in accordance with one exemplary embodiment.

DETAILED DESCRIPTION

While only certain features of the invention have been illustrated and described herein, many modifications and changes will occur to those skilled in the art. It is, therefore, to be understood that the appended claims are intended to cover all such modifications and changes as fall within the true spirit of the invention.

Embodiments herein disclose an improved Electro-Hydrodynamic (herein also referred as an "EHD") device. The EHD device may include an electrode, a power source, a gas source, and the like. The EHD device may be used for ionizing air and move a charged ion cloud to transfer momentum to the air, to produce an air jet. In a specific embodiment, although a plasma actuator is disclosed to describe the inventive techniques, it should not be construed as a limitation of the present system and techniques. In one embodiment, the plasma actuator system includes a power source to supply power to a pair of electrodes of the plasma actuator for ionizing a gaseous medium. Further, the system includes a plurality of slits on a peripheral section of both the electrodes for radially ejecting the gaseous medium from the plasma actuator.

More specifically, certain embodiments of the present system disclose a first electrode having a first slit formed on a peripheral section of the first electrode. Further, the system includes a second electrode having a second slit formed on a peripheral section of the second electrode. The second electrode is disposed concentrically around the first electrode. The system includes a gas source coupled to the first electrode for supplying the gaseous medium into the first electrode and directing the gaseous medium along a radial direction via the first slit of the first electrode. Further, the system includes a power source coupled to the first and second electrode, to supply power, so as to ionize the gaseous medium and to generate plasma. The second electrode directs the gaseous medium along the radial direction via the second slit.

Figure 1:
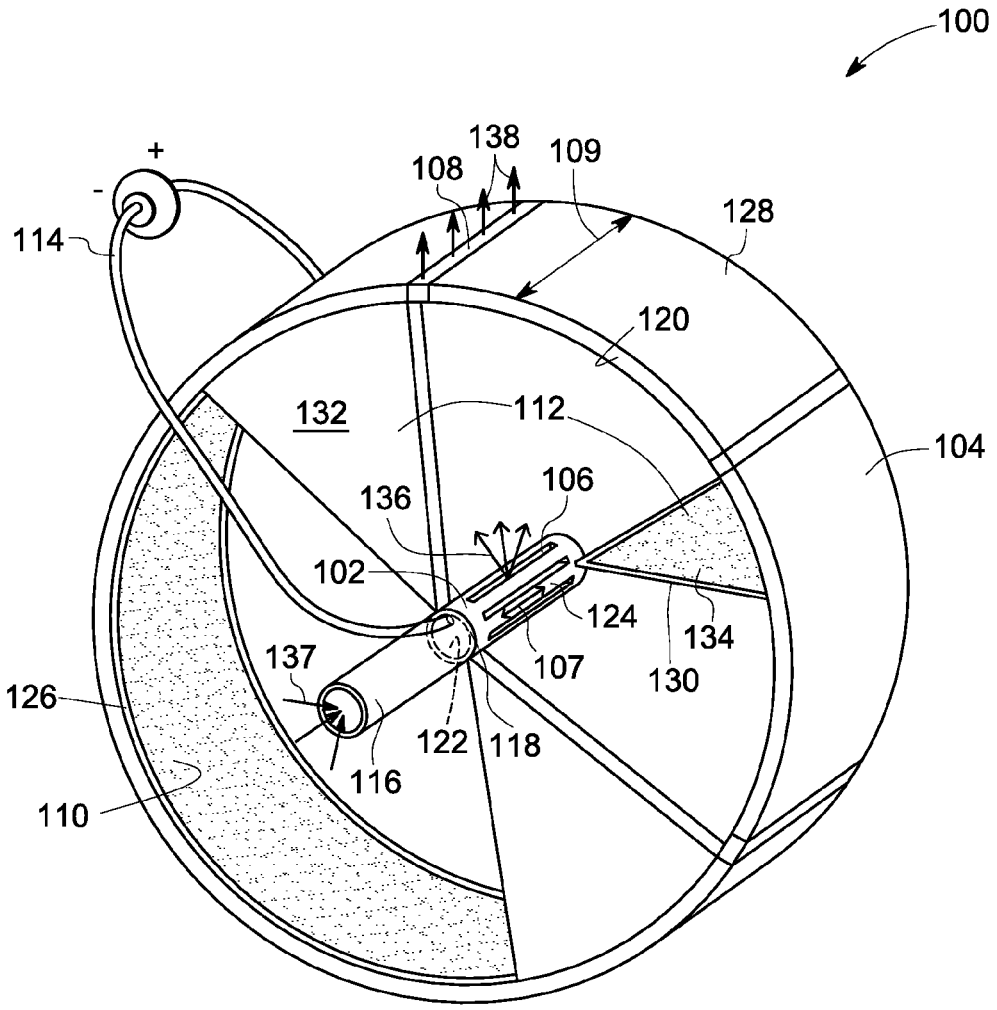
FIG. 1 illustrates an isometric view of a cylindrical shaped plasma actuator system in accordance with one exemplary embodiment.

FIG. 1 is an isometric illustration of a cylindrical shaped plasma actuator system 100. In the illustrated embodiment, the cylindrical shaped plasma actuator system 100 includes a first electrode 102 having a first slit 106, a second electrode 104 having a second slit 108, a first layer 110, a pair of side walls 112, a power source 114, and a gas source 116.

The first electrode 102 is coupled to the second electrode 104 via the pair of side walls 112. The pair of side walls 112 may be disposed on either side respectively of the first electrode 102 and the second electrode 104. In this embodiment, the first electrode 102 and the second electrode 104 have a cylindrical shape. The diameter of the first electrode 102 is smaller than the diameter of the second electrode 104. The second electrode 104 is disposed concentrically around the first electrode 102. The first electrode 102 includes a first peripheral section 118 having an inner peripheral surface 122 and an outer peripheral surface 124. The first slit 106 is formed in the first peripheral section 118 of the first electrode 102. In the illustrated embodiment, a plurality of first slits 106 is formed spaced apart in the first peripheral section 118 of the first electrode 102. The space between the plurality of first slits 106 may vary depending on the application and design criteria. In the illustrated embodiment, the first slit 106 is formed along an axial direction 107 of the first peripheral section 118. In certain embodiments, the first slit 106 may be formed along a different direction of the first peripheral section 118 of the first electrode 102. The orientation of the first slit 106 on the first peripheral section 118 of the first electrode 102 may vary depending on the application and design criteria. In the illustrated embodiment, the first slit 106 may be formed in at least a portion of the first peripheral section 118. In this example, the first slit 106 is of three-fourth length, along the axial direction 107 of the first peripheral section 118. The length of the first slit 106 may also vary depending on the application and design criteria. The first slit 106 is designed to direct a gaseous medium 137 along a radial direction 136 from the first electrode 102.

The second electrode 104 includes a second peripheral section 120 having an inner peripheral surface 126 and an outer peripheral surface 128. The second slit 108 is formed in the second peripheral section 120 of the second electrode 104. In certain embodiments, a plurality of second slits 108 are spaced apart and formed in the second peripheral section 120 of the second electrode 104. The space between the pluralities of the second slits 108 may vary depending on the application and design criteria. In the illustrated embodiment, the second slit 108 is formed along an axial direction 109 of the second peripheral section 120. In certain embodiments, the second slit 108 may be formed along a different direction of the second peripheral section 120 of the second electrode 104. The orientation of the second slit 108 on the second peripheral section 120 of the second electrode 104 may vary depending on the application and design criteria. In the illustrated embodiment, the second slit 108 may be formed in at least a portion of the second peripheral section 120. In this embodiment, the second slit 108 is of three-fourth length, along the axial direction 109 of the second peripheral section 120. The length of the second slit 108 may also vary depending on the application and design criteria. The second slit 108 is designed to eject the gaseous medium 137 along a radial direction 138 from the second electrode 104. Further, the first layer 110 is disposed on the inner peripheral surface 126 of the second electrode 104. In one embodiment, the first layer 110 is a first dielectric layer. In certain other embodiments, the first layer 110 is a first partially conductive layer. Based on the application and the design criteria, either the first dielectric layer 110 or the first partially conductive layer 110 may be disposed on the inner peripheral surface 126 of the second electrode 104. In one embodiment, the dielectric layer may include polyimide film (for example "kapton"), and polytetrafluoroethylene (for example "Teflon"). The partially conductive layer may include any semi conductive material such as silicon, gallium, and arsenide.

In the illustrated embodiment, the first slit 106 and the second slit 108 have a rectangular shape. In certain other embodiments, the first slit 106 and the second slit 108 may be of square shape, circular shape, or oval shape, depending on the application and design criteria.

The side wall 112 discussed herein includes an inner peripheral surface 130 and an outer peripheral surface 132. A second layer 134 is disposed on the inner peripheral surface 130 of the side wall 112. In one embodiment, the second layer 134 is a second dielectric layer. In certain other embodiments, the second layer 134 is a second partially conductive layer. Based on the application and the design criteria, either the second dielectric layer 134 or the second partially conductive layer 134 may be disposed on the inner peripheral surface 130 of the side wall 112. In certain embodiments, the side wall 112 may include a plurality of slits (not represented in FIG. 1). The plurality of slits may be used for both feeding the gaseous medium 137 inside the plasma actuator 100, and ejecting the gaseous medium 137 from the plasma actuator 100.

The power source 114 is coupled to the first electrode 102 and the second electrode 104 for supplying electric power to the electrodes. In the illustrated embodiment, the negative end of the power source 114 is coupled to the first electrode 102 and the positive end of the power source 114 is coupled to the second electrode 104. The power source 114 may supply a direct current, or an alternating current, or a pulsed current.

The gas source 116 is coupled to the first electrode 102. In the illustrated embodiment, the gas source 116 is coupled to one end of the first electrode 102. In one embodiment, the gas source 116 may supply the gaseous medium 137 such as air or the like. In certain other embodiments, the gas source 116 may be a compressor or the like.

Figure 2:
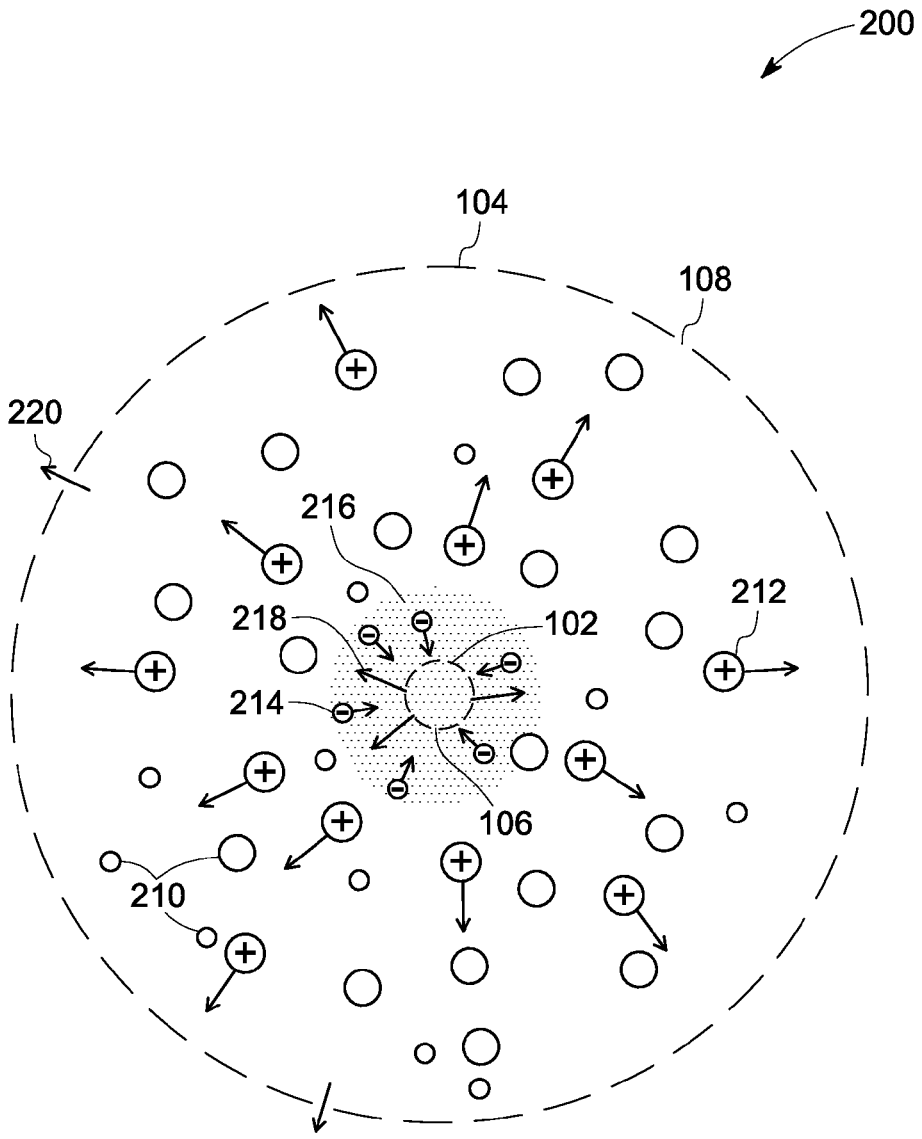
FIG. 2 is a diagrammatical representation of a plasma actuator in accordance with one exemplary embodiment.

FIG. 2 is a diagrammatical representation of functioning of the plasma actuator 200 in accordance with one embodiment of the present invention. The functioning of the plasma actuator 200 is explained in conjunction with the cylindrical shaped plasma actuator system 100 of FIG. 1.

In one embodiment, the gas source is used to supply a gaseous medium 210 into the first electrode 102. The gaseous medium 210 is directed through the first slit 106 formed in the first peripheral section of the first electrode 102 along a radial direction 218 of the first electrode 102. The power source is coupled to the first electrode 102 and the second electrode 104. The power source is used for supplying electric power, preferably a high voltage electric power, to the first electrode 102 and the second electrode 104. The supplied electric power ionizes the gaseous medium 210 in the vicinity of the first electrode 102 to generate plasma 216. The ionization of the gaseous medium 210 results in generation of a positive ion(s) 212, an electron(s) (not shown in FIG. 2), and a negative ion(s) 214. In one embodiment, the positive ions 212, the negative ions 214 and the electrons may be referred to as charged particles. During the ionization process, the electrons in the vicinity of the first electrode 102 accelerate towards the first electrode 102, and will break-down neutral molecules of a gaseous medium 210 into negative ion 214 and positive ions 212. As a result, a cloud of the charged particles is generated (also referred to as the plasma 216) around the first electrode 102. Subsequently, the positive ions 212 are separated out of the plasma 216 by the applied electric field and are pushed (also referred as a "drift") towards the second electrode 104. The positive ions 212 of the charged particles 212 transfer the momentum to the gaseous medium 210. The positive ions 212 recombine on the inner peripheral surface of the second electrode 104. The gaseous medium 210, which had gained momentum from the protons 212 is ejected out of the plasma actuator 100 along the radial direction 220 via the second slit 108 of the second electrode 104.

The first dielectric layer is disposed on the inner peripheral surface of the second electrode 104, to prevent arcing between the first electrode 102 and the second electrode 104. In one embodiment, to mitigate the charge build-up (i.e. the positive ions 212, the electrons and the negative ions 214) on the dielectric surface of the second electrode 104, the polarity of the high voltage power source may be switched periodically. In some embodiments, a first partially conductive layer may be disposed on the inner peripheral surface of the second electrode 104, which may allow the plasma actuator to function with dc voltage The cylindrical shaped plasma actuator 100 is designed to over-come the space charge limitation. According to Gauss's law, a charge acts as a source for an electric field, and adding more charge leads to higher electric field induced by the charge. In such cases, the electric field may not exceed a breakdown value. The charged particles in the ionization region separates, modifying the electric field until the electric field value drops below a breakdown value:

$$div\ \vec{E} = \frac{\rho}{\varepsilon_0} \tag{1}$$

where, $$div = \frac{\partial}{\partial x} + \frac{\partial}{\partial y} + \frac{\partial}{\partial z}$$

is a divergence operator, $$\frac{\partial}{\partial x} + \frac{\partial}{\partial y} + \frac{\partial}{\partial z}$$

are partial derivatives with respect to x, y, and z, where, x, y, and z represent Cartesian coordinates, $\vec{E}$ is a vector of the electric field, ρ is electric charge density, $\in_0=8.85\times10^{-12}$ Farad/meter is a universal constant referred to as vacuum permittivity.

The charged particles drift velocity is considered to be linear to the supplied electric field, and the coefficient of proportionality μ is referred to as mobility of ions. In cylindrical coordinates the Gauss's law, the continuity equation for the charged particles, and an expression for a drift velocity can be as represented as mentioned below:

$$\frac{E}{x} + \frac{dE}{dx} = \frac{en}{\varepsilon_0} \tag{2}$$

$$J = 2\pi xenv \tag{3}$$

$$v = \mu E \tag{4}$$

where Equation (2) represents Poisson equation, Equation (3) represents Continuity equation, and Equation (4) represents Drift approximation, dE is change in the electric field over the distance dx, e is an electric charge per particle, $\in_0=8.85\times10^{-12}$ Farad/meter is a universal constant called vacuum permittivity, J is linear current density i.e. amount of the electric charge crossing lateral area of cylinder with a unit height per second, n number of charged particles per unit volume, E is a radial component of the electric field, x is a distance from the centerline of the cylinder, π is a mathematical constant that is the ratio of a circle's circumference to circle's diameter, and μ is the ion mobility.

From the above equations (2), (3), and (4), a drift velocity V(x), electric field E(x), electric potential U(x), and charged particles concentration n(x), can be determined as mentioned below:

$$v(x) = \frac{3}{2}\frac{\mu U}{L}\left(\frac{x}{L}\right)^{1/2} \tag{5}$$

$$E(x) = \frac{3}{2}\frac{U}{L}\left(\frac{x}{L}\right)^{1/2} \tag{6}$$

$$U(x) = -U\left(\frac{x}{L}\right)^{3/2} \tag{7}$$

$$n(x) = \frac{3\varepsilon_0 U}{4eL^2}\left(\frac{x}{L}\right)^{-1/2} \tag{8}$$

$$\frac{9\mu\varepsilon_0}{8}U^2 = L^3 J \tag{9}$$

where, U is an electric potential, μ is the ion mobility, L is a gap between the electrodes which is the radii difference, x is a distance from the centerline of the cylinder, $\in_0=8.85\times10^{-12}$ Farad/meter is a universal constant called vacuum permittivity, J is linear current density i.e. amount of the electric charge crossing lateral area of cylinder with a unit height per second, and e is an electric charge per particle, the equation (9) represents Volt-amp characteristic of the discharge, i.e. relationship between the applied voltage and transmitted current.

From the Equations (5), (6), (7), (8) and (9), Force F or flow velocity created by the charged particles can be derived, as mentioned below:

$$F = \frac{9\varepsilon_0 U^2}{8L^2} = \frac{\varepsilon_0 E^2}{2} \quad (10)$$

From the Equation (10), it is ascertained that even for relatively small sized exemplary cylindrical actuators (for example, r=1 mm, and R=20 mm), the created flow velocity of the gaseous medium is six times higher relative to an actuator having a plane configuration, where "r" is the radius of the first electrode 102, and "R" is the radius of the second electrode 104.

FIG. 3*a* illustrates a cylindrical shaped plasma actuator system 300 having a plurality of sectors 320 in accordance with one embodiment of the present invention. In the illustrated embodiment of the present invention, the plasma actuator system 300 includes a first electrode 302, a second electrode 304, a first slit 306, a second slit 308, and a pair of side walls 310.

The cylindrical shaped plasma actuator system 300 including the first electrode 302, the second electrode 304 and the pair of side walls 310 (In FIG. 3, the other side wall among the pair of the side walls 310 is not illustrated) are divided to form the plurality of sectors 320. The width of the sector 320 gradually increases from one end 312 towards the other end 314. The cylindrical shaped plasma actuator system 300 includes a power source 316 coupled to the first electrode 302 and the second electrode 304 for supplying a high voltage electric power to the electrodes.

FIG. 3*b* illustrates the sector 320 of the cylindrical shaped plasma actuator system 300 in accordance with an embodiment of FIG. 3*a*. The sector 320 includes a portion 322 of the first electrode 302, a portion 324 of the second electrode 304, and pair of side walls 330,331.

In the illustrated embodiment, the sector 320 has one first slit 306 formed in the portion 322 of the first electrode 302 and one second slit 308 formed in the portion 324 of the second electrode 304. In certain embodiments, a plurality of first slits 306 and second slits 308 may be formed on the portion 322 of the first electrode 302 and the portion 324 of the second electrode 304 respectively depending on the application and design criteria. In some embodiments, the sector 320 may have a varied cross sectional area along the length of the sector 320. Such a design facilitates to reduce the viscous losses of the gaseous medium flowing along the radial direction 338 from the first electrode 302 to the second electrode 304. In the illustrated embodiment, a first dielectric layer 332 is disposed on an inner peripheral surface of the portion 324 of the second electrode 304. Similarly, a second dielectric layer 334 is disposed on an inner peripheral surface of the pair of side walls 330, 331. The second dielectric layer 334 is disposed on both the pair of side walls 330, 331. The width of the sector 320 gradually increases from an end 321 towards the other end 323. In the illustrated embodiment, the sector 320 includes a power source 336 coupled to the portion 322 of the first electrode 302 and the portion 324 of the second electrode 304 for supplying a high voltage electric power. In certain embodiments, the sector 320 may not be coupled to a separate power source 336. In the illustrated embodiment, a gaseous medium is directed along a radial direction 325 through the first slit 306. The ionization of gaseous medium leads to the formation of a plasma 329, and the gaseous medium is ejected from the sector 320 of the cylindrical shaped plasma actuator 300, through the second slit 308 along a radial direction 327.

FIG. 3*c* is a diagrammatical representation of a multi-sector 340 of a cylindrical shaped plasma actuator system in accordance with an embodiment of the present invention. Such an actuator system may include a plurality of such multi-sectors 340. The illustrated multi-sector 340 includes a first electrode portion 342, a plurality of second electrode portions 343, 344, 345, and a pair of side walls 350, 352 on either side respectively of the multi sector 340.

In the illustrated embodiment, the multi-sector 340 has four first slits 307 formed in the first electrode portion 342, four second slits 309 formed in the second electrode portion 343, 344, and six second slits 309 formed in the second electrode portion 345. In the illustrated embodiment, the multi-sector 340 has three sub-sectors 353, 354, 356. The three sub-sectors 353, 354, 356 have different cross sectional areas. In the illustrated embodiment, the cross sectional area varies along the length of the each sector 340. The sub-sectors 353, 354, 356 include the second electrode portions 343, 344, 345 respectively and also the pair of side walls 350, 352 respectively. A first dielectric layer 358 is disposed on an inner peripheral surface of the second electrode portions 343, 344, 345. Similarly, a second dielectric layer 360 is disposed on an inner peripheral surface of the pair of side walls 350, 352. Such a design facilitates to further reduce the viscosity of a gaseous medium flowing along the radial direction 364 from the first electrode 302 to the second electrode 304 respectively. In the illustrated embodiment, a power source 362 coupled to the first electrode portion 342 and the second electrode portions 343, 344, 345 for supplying a high voltage electric power. The power source 362 is used to supply power at different voltages across the sub-sectors 353, 354, 356. In one example, the power source 362 may supply a higher voltage to the sub-sector 353, a medium voltage to the sub-sector 354 and a low voltage to the sub-sector 356. In certain other embodiments, the sub-sectors 353, 354, 356 of the multi-sector 340 may not be coupled to a separate power source. In this embodiment, the plurality of first slits 307 formed on the first electrode portion 342 directs the gaseous medium along a radial direction 361. The power source 362 ionizes the gaseous medium leading to the formation of plasma 363. A charged particle separated from the plasma 363 imparts momentum to the gaseous medium. The gaseous medium is ejected from through the second slits 309 along a radial direction 365.

FIG. 4 illustrates an isometric view of a spherical shaped plasma actuator system 400 in accordance with another embodiment of the present invention. In the illustrated embodiment, the spherical shaped plasma actuator system 400 includes a first electrode 402, a second electrode 404, a power source 414, and a gas source 416.

The first electrode 402 is disposed around the second electrode 404. The first electrode 402 is coupled to the second electrode 404 via a suitable connecting device. In the illustrated embodiment, the first electrode 402 is coupled to the second electrode 404 via the gas source 416. Any possible variation of connecting device, for coupling the first electrode 402 with the second electrode 404 may be considered. In this embodiment, the first electrode 402 and the second electrode 404 have a spherical shape. The first electrode 402 includes a first peripheral section 418 having an inner peripheral surface 422 and an outer peripheral surface 424. In the illustrated embodiment, a plurality of first slits 406 is spaced apart in the first peripheral section 418 of the first electrode 402. The space between the plurality of the first slits 406 may vary depending on the application and design criteria. The orientation of the first slit 406 in the first peripheral section 418 of the first electrode 402 may vary depending on the application and design criteria. In the illustrated embodiment, the first slit 406 is formed in at least a portion of the first peripheral section 418. The first slit 406 is designed to direct a gaseous medium from the gas source 416, along a radial direction 436.

The second electrode 404 includes a second peripheral section 420 having an inner peripheral surface 426 and an outer peripheral surface 428. In the illustrated embodiment, a plurality of second slits 408 is spaced apart in the second peripheral section 420 of the second electrode 404. The space between the plurality of second slits 408 may vary depending on the application and design criteria. The orientation of the second slit 408 in the second peripheral section 420 of the second electrode 404 may vary depending on the application and design criteria. In the illustrated embodiment, the plurality of second slits 408 may be formed in at least a portion of the second peripheral section 420. The shape of the second slit 408 may also vary depending on the application and design criteria. Further, a first layer 410 disposed on the inner peripheral surface 426 of the second electrode 404. In one embodiment, the first layer 410 is a first dielectric layer. In certain other embodiments, the first layer 410 is a partially conductive layer. Based on the application and the design criteria, either the first dielectric layer 410 or the first partially conductive layer 410 is disposed on the inner peripheral surface 426 of the second electrode 404. The second slit 408 is designed to eject the gaseous medium along a radial direction 438 from the second electrode 404. The shape of the first slit 406, the second slit 408 may vary depending on the application and design criteria. In the illustrated embodiment, the first slit 406 and the second slit 408 have a circular shape. In certain other embodiments, the first slit 406 and the second slit may be of square shape, rectangular shape, or oval shape, depending on the application and design criteria.

The power source 414 is coupled to the first electrode 402 and the second electrode 404 for supplying electric power to the electrodes 402, 404. In the illustrated embodiment, the positive end of the power source 414 is coupled to the first electrode 402 and the negative end of the power source 414 is coupled to the second electrode 404.

In this embodiment, the gas source 416 couples the first electrode 402 to the second electrode 404. Additionally, the gas source 416 feeds the gaseous medium into the first electrode 402. In the illustrated embodiment, one end 415 of the gas source 416 (i.e. pipe) is coupled to the first electrode 402 and the other end 417 of the gas source is opened to the atmosphere. A second layer 434 is disposed on an outer peripheral surface 432 along a longitudinal direction 435 of the gas source 416. In one embodiment, the second layer 434 is a second dielectric layer. In certain other embodiments, the second layer 434 is a second partially conductive layer. Based on the application and the design criteria, either the second dielectric layer 434 or the second partially conductive layer 434 may be disposed on the outer peripheral surface 432 of the gas source 416. The flow velocity created by the spherical shaped plasma actuator 400 is up to three times higher compared to an actuator having a plane configuration.

FIG. 5*a* is a sector 520 of the spherical shaped plasma actuator system 400 in accordance with an embodiment of the present invention. The sector 520 is explained in conjunction with the spherical plasma actuator system 400 of FIG. 4. The spherical shaped plasma actuator system 400 having the first electrode 402, the second electrode 404, and the connecting device 416 is divided to form a plurality of sectors 520. In the illustrated embodiment, the sector 520 includes a portion 522 of the first electrode 402, a portion 524 of the second electrode 404, and pair of side walls 530,531.

In the illustrated embodiment, the sector 520 has one first slit 406 and one second slit 408. In certain other embodiments, the plurality of first slits 406 and the second slits 408 may be formed on the portion 522 of first electrode 402 and the portion 524 of second electrode 404 respectively depending on the application and design criteria. The sector 520 has varied cross sectional area along the length of the sector 520. The cross sectional area of the sector 520 facilitates to reduce the viscosity of the gaseous medium flowing along a radial direction 510 from the first electrode 402 to the second electrode 404. A first dielectric layer 532 is disposed on an inner peripheral surface of the second electrode portion 524. Similarly, a second dielectric layer 534 is disposed on an inner peripheral surface of the pair of side walls 530, 531. The width of the sector 520 gradually increases from an end 540 towards the other end 538. In the illustrated embodiment, a power source 536 is coupled to the portion 522 of the first electrode 502 and the portion 524 of the second electrode 504 for supplying a high voltage electric power. In the illustrated embodiment, a positive end 537 of the power source 536 is coupled to the second electrode portion 524 and a negative end 535 of the power source 536 is coupled to the first electrode portion 522. In the illustrated embodiment, a gaseous medium is directed along a radial direction 542 through the first slit 406. The ionization of gaseous medium leads to the formation of plasma 544, and the gaseous medium is ejected from the sector 520 of the spherical shaped plasma actuator 400, through the second slit 408 along a radial direction 546.

FIG. 5*b* is a multi-sector 550 of a spherical shaped plasma actuator system in accordance with an embodiment of the present invention. The multi-sector 550 is explained in conjunction with the spherical plasma actuator system 400 of FIG. 4. The multi-sector 550 includes a first electrode portion 552, a plurality of second electrode portions 553, 554, and pair of side walls 560, 562 on either side of the multi-sector 550.

In the illustrated embodiment, the multi-sector 550 has one first slit 507 formed on the first electrode portion 552, and one second slit 509 formed in the second electrode portion 553, 554. In certain other embodiments, a plurality of first slits 507 and a plurality of second slits 509 may be formed in the first electrode portion 552 and the second electrode portions 553, 554 respectively depending on the application and design criteria. In the illustrated embodiment, the multi-sector 550 has two sub-sectors 564, 566. The two sub-sectors 564, 566 have different cross sectional areas. In another embodiment, the cross sectional areas of the two sub-sectors 564, 566 may be similar. The cross sectional area varies along the length of the each of the sub-sectors 564, 566. The sub-sectors 564, 566 include the second electrode portions 553, 554 respectively. The cross sectional area of the multi-sector 550 facilitates to reduce the viscosity of the gaseous medium flowing along a radial direction 576 from the first electrode 402 to the second electrode 404. A first dielectric layer 568 is disposed on an inner peripheral surface of the second electrode portions 553, 554. Similarly, a second dielectric layer 570 is disposed on an inner peripheral surface of the side walls 560, 562. In the illustrated embodiment, a power source 572 coupled to the first electrode portion 552 and the second electrode portions 553, 554 for supplying a high voltage electric power. The power source 572 is used to supply power at different voltages across the sub-sectors 564, 566. In one embodiment, the power source 572 may supply a higher voltage to the sub-sector 564, and a medium voltage to the sub-sector 566. In this example, the plurality of first slits 507 directs the gaseous medium along a radial direction 574. The power source 572 ionizes the gaseous medium leading to the formation of plasma 575. A charged particle separated from the plasma 575 imparts momentum to the gaseous medium. The gaseous medium is ejected through the second slit 509 along a radial direction 578.

FIG. 6 is a radar chart 600 representing a circumferential distribution of plasma induced pressure in a plasma actuator in accordance with an exemplary embodiment of the present invention. In one embodiment, a plurality of vectors 602, 604, 606, 608, 610, 612, 614, 616 represent a plurality of slits formed on a second electrode 618 of an exemplary plasma actuator 619. A plurality of curves 620, 622, 624, 626, 628, 630, 632 are indicative of pressure of a gaseous medium ejected through the plurality of slits 602, 604, 606, 608, 610, 612, 614, 616 of the plasma actuator 619. In the illustrated embodiment, the pressure of the gaseous medium ejected through the eight slits is represented by units of 10 Pascal up to 70 Pascal. A conventional planar configuration of a plasma actuator ejects the gaseous medium at a pressure of 40 Pascal as indicated by the curve 634. In one embodiment, the results illustrated in the radar chat 600 are derived through one or more experiments using the exemplary plasma actuator 619. The exemplary plasma actuator 619 may be cylindrical shaped or spherical shaped. The curve 636 is representative of the pressure of the gaseous medium attained using the cylindrical shaped plasma actuator 619. Similarly, the curve 638 is representative of the pressure attained using a spherical shaped plasma actuator. From the radar chart, it is clearly evident that the cylindrical shaped plasma actuator 619 and the spherical shaped plasma actuator over comes the space charge limitation of the conventional one-dimensional plasma actuator.

FIG. 7 illustrates an aircraft 700 having a plasma actuator system 708 in accordance with one exemplary embodiment. The aircraft includes a nose 702, a pair of wings 706 (the other wing among the pair of wings 706 is not shown), and a plurality of exemplary plasma actuators 708.

In the illustrated embodiment, the plurality of plasma actuators 708 is disposed at a trailing end 710 of the wing 706 (herein also referred as an "airfoil"). In one embodiment, the plasma actuator 708 includes a first electrode, a second electrode, and a power source. The first electrode and the second electrode have at least one of a cylindrical shape, or a spherical shape, or combinations thereof. The first electrode may include a plurality of first slits and the second electrode may include a plurality of second slits. The first electrode of the plasma actuator 708 may receive a gaseous medium via the plurality of first slits. The power source may supply high voltage power to ionize the gaseous medium around the first electrode and generate plasma. The gaseous medium may then be ejected from the plasma actuator through the plurality of second slits along a radial direction. The aircraft 700 during flight may face the wind flowing along a longitudinal direction indicated by the reference numeral 712. At least one among the plurality of the plasma actuator 708 disposed on the trailing end 710 of the airfoil 706 reduces the drag, by ejecting the gaseous medium along the horizontal direction 714 of the aircraft 700. In another embodiment, at least one among the plurality of the plasma actuator 708 ejects the gaseous medium along a vertical direction 716 of the aircraft 700 i.e. along a plane 704 perpendicular to the airfoil 706.

An exemplary EHD device having cylindrical and spherical shaped electrodes has advantages associated with overcoming the space charge limitation. Conventional ion wind and DBD plasma actuators have one dimensional geometries or planar configuration geometries, and thus subjected to the space charge limitation. The exemplary electrodes having cylindrical or spherical configuration overcomes the space charge limitation and generates higher flow velocities. The potential applications of the exemplary cylindrical or spherical shaped plasma actuators may include various flow control application, such as separation control, drag reduction, noise control, lift destruction, and the like. The drag reduction application may be used on airplane wings, wind and gas turbines, and the like. Additionally, the exemplary actuators may be used as a plasma thruster to propel small UAVs or be utilized in hair driers and fans to move the air.

The invention claimed is:

1. A plasma actuator system comprising:

a first electrode having a first slit formed in a first peripheral section for directing flow of a gaseous medium along a radial direction;

a second electrode disposed concentrically around the first electrode, wherein the second electrode has a second slit formed in a second peripheral section for directing flow of the gaseous medium along the radial direction;

a pair of side walls coupled respectively to opposing ends of the first and second electrodes, wherein each side wall extends radially from the first peripheral section of the first electrode to the second peripheral section of the second electrode, and wherein the pair of side walls extends along respective circumferences of the first and second peripheral sections;

a first dielectric layer disposed on an inner peripheral surface of the second electrode, and a second dielectric layer disposed on an inner peripheral surface of at least one side wall among the pair of side walls; and a power source coupled to the first electrode and the second electrode, for supplying electric power to the first electrode and the second electrode.

2. The plasma actuator system of claim 1, wherein the first electrode has a cylindrical shape.

3. The plasma actuator system of claim 1, wherein the second electrode has a cylindrical shape.

4. The plasma actuator system of claim 1, wherein the first slit is formed in at least a portion of the first peripheral section.

5. The plasma actuator system of claim 1, wherein the second slit is formed in at least a portion of the second peripheral section.

6. The plasma actuator system of claim 1, wherein the first electrode, the second electrode and the pair of side walls are divided to form a plurality of sectors.

7. The plasma actuator system of claim 6, wherein the first slit comprises a plurality of first slits and the second slit comprises a plurality of second slits, wherein the at least one sector among the plurality of sectors comprises at least one first slit and the second slit.

8. The plasma actuator system of claim 7, wherein each sector comprises a first subsector having a first cross sectional area, and a second sub-sector having a second cross sectional area different from the first cross sectional area.

9. The plasma actuator system of claim 7, wherein the first sub-sector and the second sub-sector are coupled to the power source, for receiving electric power from the power source.

10. The plasma actuator system of claim 1, wherein the first slit comprises a plurality of first slits spaced apart and formed along an axial direction of the first peripheral section of the first electrode.

11. The plasma actuator system of claim 1, wherein the second slit comprises a plurality of second slits spaced apart and formed along an axial direction of the second peripheral section of the second electrode.

12. The system of claim 1, further comprising a gas source coupled to the first electrode, for feeding the gaseous medium into the first electrode.

13. An apparatus comprising:

an airfoil device;

a plasma actuator system coupled to the airfoil device; wherein the plasma actuator system comprises:

a first electrode having a first slit formed in a first peripheral section for directing flow of a gaseous medium along a radial direction;

a second electrode disposed concentrically around the first electrode, wherein the second electrode has a second slit formed in a second peripheral section for directing flow of the gaseous medium along the radial direction;

a pair of side walls coupled respectively to opposing ends of the first and second electrodes, wherein each side wall extends radially from the first peripheral section of the first electrode to the second peripheral section of the second electrode, and wherein the pair of side walls extends along respective circumferences of the first and second peripheral sections;

a first dielectric layer disposed on an inner peripheral surface of the second electrode, and a second dielectric layer disposed on an inner peripheral surface of at least one side wall among the pair of side walls; and a power source coupled to the first electrode and the second electrode, for supplying electric power to the first electrode and the second electrode.

* * * * *